United States Patent [19]

Beckham et al.

[11] 4,099,577

[45] Jul. 11, 1978

[54] WORK VEHICLE AND RING GEAR BEARING ARRANGEMENT THEREFOR

[75] Inventors: Joel M. Beckham; Gene B. Easterling; Reginald K. Ringel, all of Decatur; Egon E. Wolff, Forsythe, all of Ill.

[73] Assignee: Caterpillar Tractor Co., Peoria, Ill.

[21] Appl. No.: 778,652

[22] Filed: Mar. 17, 1977

[51] Int. Cl.[2] ..... E02F 3/76

[52] U.S. Cl. ..... 172/781; 172/747; 172/796

[58] Field of Search ..... 172/742, 747, 781, 791, 172/792, 793, 795, 796, 797; 212/66, 67, 68, 69; 214/132, 151; 260/42, 18; 308/238, 239, DIG. 8

[56] References Cited

U.S. PATENT DOCUMENTS

| | | | |
|---|---|---|---|
| 2,670,551 | 3/1954 | Keeler | 172/796 |
| 3,056,709 | 10/1962 | Rising et al. | 260/42.18 X |
| 3,655,611 | 4/1972 | Mueller et al. | 260/42.18 |
| 3,712,384 | 1/1973 | Fisher | 172/796 |
| 3,888,357 | 6/1975 | Bauer et al. | 212/68 |
| 3,926,818 | 12/1975 | Albertson et al. | 308/238 X |
| 3,989,112 | 11/1976 | Cole et al. | 172/796 |
| 4,015,669 | 4/1977 | Cole | 172/796 |

*Primary Examiner*—Richard T. Stouffer
*Attorney, Agent, or Firm*—John L. James

[57] ABSTRACT

A ring gear bearing arrangement for motorgraders and method for assembling the vehicle with a ring gear that is rotatably supported by a frame of the vehicle through contact only with organic plastic bearing strips which maintain the ring gear against movement in any direction other than rotationally about the ring gear axis.

7 Claims, 5 Drawing Figures

WORK VEHICLE AND RING GEAR BEARING ARRANGEMENT THEREFOR

BACKGROUND OF THE INVENTION

In the construction and operation of a vehicle having a ring gear, there are often relatively large forces that are subjected onto the ring gear by an associated work element such as a load carrying bucket or an earthmoving blade, for example. These large forces are generally applied from one side of the ring gear which urges the ring gear toward a canted position relative to means that are supporting the ring gear and rotatably connecting the ring gear on the frame.

These other than axial or normal to axial loads that are subjected onto the circle gear cause the gear or the gear supporting mechanism to become undesirably worn owing to relative high pressures between the elements during rotation of the ring gear. The undesirable wearing results in a waste of replacement time, material and labor.

The present invention is directed to overcoming one or more of the problems as set forth above.

According to the present invention, a work vehicle has a method for assembling and a construction sufficient for protecting the ring gear from undesirable wear.

In the method, a ring gear is connected to a work element, a plurality of first load bearing organic strips are inserted into recesses on a lever portion of a frame of the vehicle, and the ring gear is moved into contact with the first load bearing strips. A plurality of second load bearing strips having lugs are inserted into respective generally vertical slots of a plurality of shoes and covering of an upper surface and outer end of the shoes. The shoes and associated second strips are thereafter moved, connected to the frame, and positioned for forcibly contacting the ring gear with only the organic plastic first and second strip and maintaining the ring gear against movement in any direction other than rotatably about its axis.

The work vehicle has a drawbar frame having a plurality of recesses, a work element, ring gear shoes, first and second shoe positioning means, and first and second bearing strips of organic plastic having fiber glass strands. The ring gear is fixedly connected to the work element. The ring gear has first and second legs and is of a general "L" configuration. The plurality of shoes each have at least one slot extending generally vertically along an end of the shoe in the installed position with the shoe movably connected to the frame and the first ring gear leg positioned between the shoes and an overlaying frame portion. The first means selectively, movably, and fixedly connects the shoe to the frame and the second means is provided for controllably moving the shoe toward and from the frame.

A plurality of first bearing strips are positioned between and in load bearing contact with the first leg of the ring gear and the overlaying frame portion. Each of the first bearing strips has at least one portion of a construction sufficient for generally vertical insertion into a respective recess, general vertical removal from said recess and for maintaining said first bearing strip against generally horizontal movement relative to said frame in response to preselected forces subjected thereon by the ring gear. The first bearing steps are formed of organic plastic having fiberglass strands and are of a thickness sufficient for maintaining the ring gear spaced from the overlying frame.

A plurality of second bearing strips are positioned over an end portion of a respective shoe and between and in load carrying contact with said shoe and the first and second legs of the ring gear. The second strips are each of a general "L" configuration. Each of said second bearing strips has at least one lug of a construction sufficient for insertion into a respective generally vertical shoe slot, generally vertical or horizontal removal from said slot and for maintaining said second bearing strip against generally horizontal movement relative to said shoe in response to forces subjected thereon by the ring gear. The second bearing strip is formed of organic plastic having fiberglass strands and is of a size sufficient for maintaining the ring gear spaced from all portions of the shoe.

DETAILED DESCRIPTION OF THE INVENTION

Figure 1:
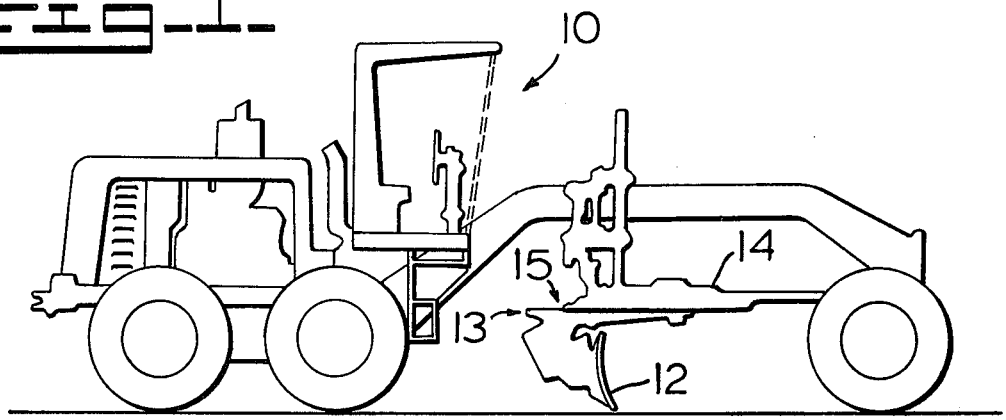
FIG. 1 is a diagrammatic view of a work vehicle having the apparatus of this invention.
Figure 2:
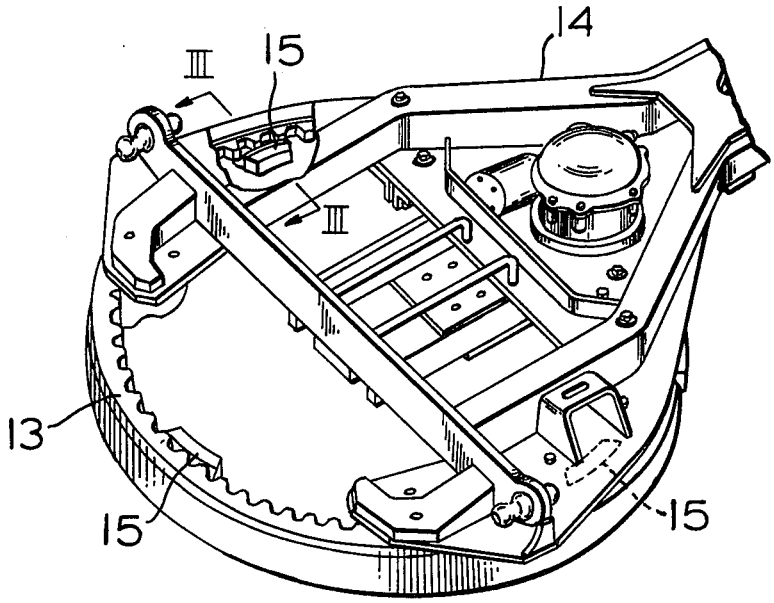
FIG. 2 is a diagrammatic view of the ring gear and shoe assembly.

Referring to FIG. 1, a work vehicle 10, for example a motor grader, or an excavator of FIG. 2, has a work element 12, for example a blade 12 of the excavator, connected to a ring gear 13. The ring gear 13 is rotatably connected to a frame 14 of the vehicle, for example a draw bar frame, by shoe assemblies 15.

Figure 3:
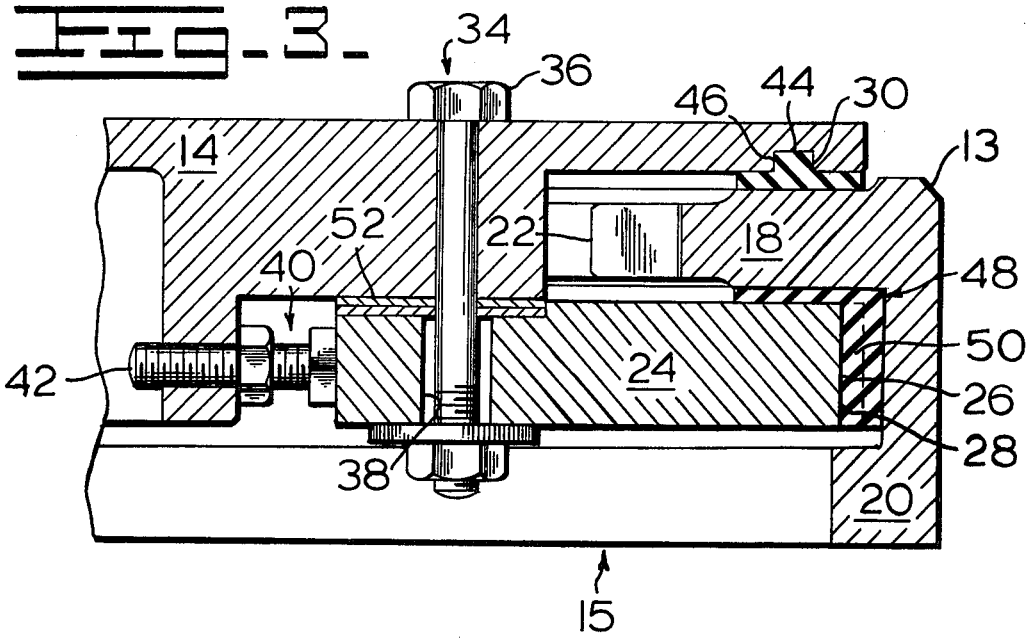
FIGS. 3 and 3A are diagrammatic cross sectional views of the ring gear-shoe assembly.

Referring to FIG. 3, the ring gear 13 has first and second legs 18, 20 and is of a general "L" configuration. Teeth 22 of the ring gear 13 define the end of the inwardly directed first leg 18 of the ring gear 13.

Figure 3A:
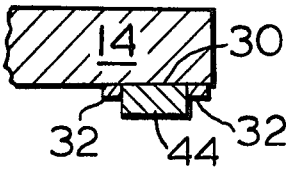

Each shoe 24 of each shoe assembly 15 has an end 26 having at least one slot 28 extending generally vertically along the end 26 in the installed position. In the installed position, the shoe assembly 15 is movably connected to the frame 14 and the first ring gear leg 18 is positioned between the shoe 24 and an overlying frame portion. Each overlying frame portion has a recess 30. The recess 30 of FIG. 3 is formed by a hole extending into the frame 14. The recess 30 can be formed by elements 32 connected to or formed on the frame 14 (See FIG. 3A).

A first means 34 is provided for selectively, movably and fixedly connecting the shoe 24 to the frame 14. The first means 34 can, for example, be a bolt 36 of a preselected diameter extending through a shoe opening 38 which has a diameter significantly greater than the bolt 36 as measured along the radius of the ring gear 13.

A second means 40 is provided for controllably moving the shoe 24 along the frame 14 in direction toward and from the ring gear 13. The second means 40 can be, for example, a threaded member 42 connected to the frame 14 and being controllably movable along a radius of the ring gear 13 and into forcible contact with an adjacently positioned respective shoe 24.

Figure 4:
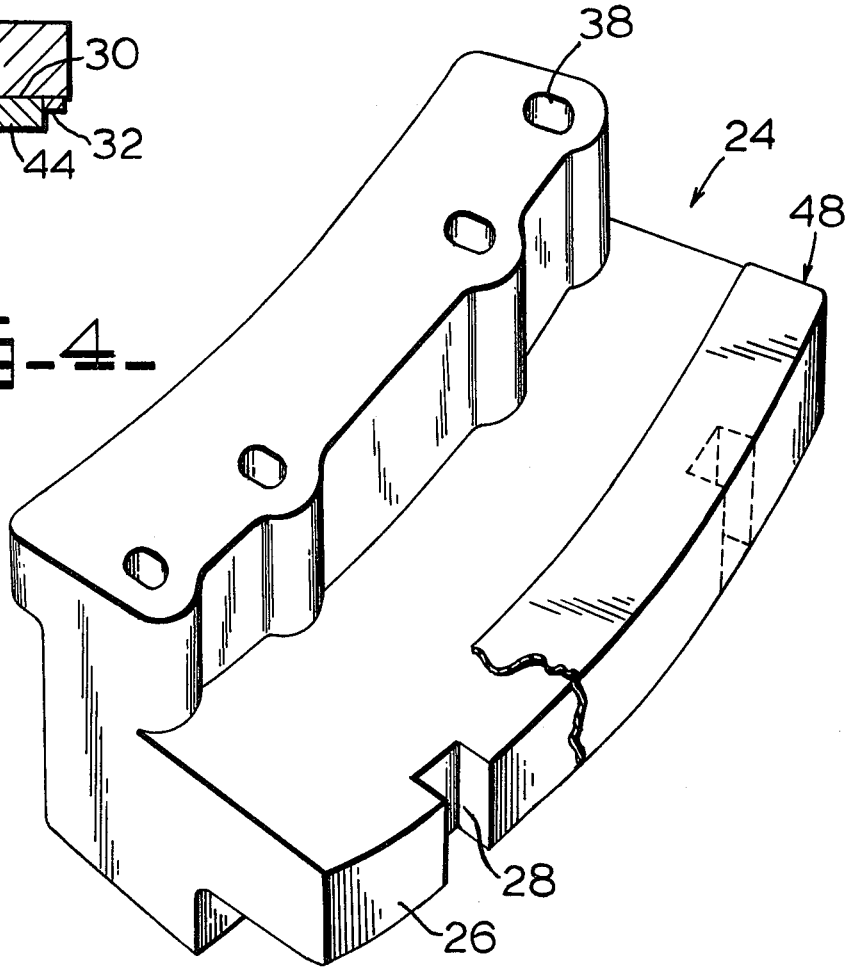
FIG. 4 is a diagrammatic isometric view of a portion of another embodiment of the shoes.

Referring to FIGS. 3 and 4, a plurality of first bearing strips 44 are positioned between and in load bearing contact with the first leg 18 of the ring gear 13 and the overlaying frame portion. Each of the first bearing strips 44 have at least one, preferably a plurality of portions 46 that are of a construction sufficient for generally vertically inserting said portion 46 into a respective recess 30, generally vertical removal from said recess 30 and for maintaining said first bearing strip 44 against generally horizontal movement relative to the frame 14 in response to preselected forces subjected thereon by the ring gear 13.

The portion 46 inserted in the recess is preferably of a total minimum area as measured along the radius of the ring gear 13 as defined by the expression $$X = \frac{\text{Cross sectional area of inserts} \times \text{shear strength of material}}{\text{Pressure} \times \text{coefficient of friction of materials interface}}$$

Where: $X$ is a number greater than 1.0

The first bearing strips are formed of ultra high molecular weight organic plastic and have a preselected amount of fiberglass strands sufficient for increasing the resistance of the strips to heat deformation and cold flow while maintaining substantially unchanged the abrasion and impact resistance properties of the organic plastic. The thickness of the load bearing strips is also a value sufficient for maintaining the ring gear spaced a preselected distance from the underlying frame. That distance is preferably about 0.8 – 1.6 cm.

The organic plastic utilized depends upon the forces that are expected to be subjected onto the bearing strips 44, 48 of a particular work vehicle. One skilled in the art can readily select the material after these forces have been determined. Example materials are polyamides, high molecular weight polyethylene and other polyolefins.

An example material that has been found to be particularly useful where the work vehicle is a motor grader or an excavator is 1900 UHMW polymer blended with 15% by weight fiberglass strands. 1900 UHMW polymer is a trade name of ultra high molecular weight high-density polyethylene that is manufactured by Hercules Incorporated of Wilmington, Del.

The example bearing strip has been proven to be resistant to impact loading, wear resistant, resistant to chemicals and abrasives, self-lubricating, and has high energy absorption properties with excellent size stability. The 15% fiberglass strands maintain against heat deflection and cold flow and provide stiffness for the resultant strip. The addition of the fiberglass strands is to be maintained in an amount sufficient to cause no detectable abrasion resistance loss and only insignificant losses of impact resistance of the polymer. One skilled in the art can easily determine the amount of fiberglass to add once the base polymer is selected and the expected loads are known.

A plurality of second bearing strips 48, preferably formed of the same material as the first 44, are removably connected to an end portion of the shoe 24 and covers the upper surface and the end 26 of the shoe 24. The second strips 48 are of a general "L" configuration. The second bearing strips 48 are positioned between and in load bearing contact with the shoe 24 and the inner surface of the first and second legs 18, 20 of the ring gear 13.

Each of the second strips 48 has at least one lug 50 of a construction sufficient for insertion into a respective generally vertical shoe slot 28, removal from the slot 28 and for maintaining said second bearing strip 48 against generally horizontal movement relative to said shoe 24 in response to forces subjected thereon by the ring gear 13. The second strips 48 are of a size sufficient for maintaining the ring gear 13 spaced from all portions of the shoe 24.

The lugs 50 preferably are of a total minimum thickness as measured along the radius of the ring gear as defined by the expression $$X = \frac{\text{Cross sectional area of lug} \times \text{shear strength of material}}{\text{Radial pressure} \times \text{coefficient of friction at materials interface}}$$

Where: $X$ is a number greater than 1.0

The configuration of the bearing strips 44, 48, as viewed from above in the installed position are of arcuate form and each preferably have a planar contacting surface.

In the method of assembling, the work vehicle 10, a plurality of first load bearing strips 44 are generally vertically inserted in respective recesses 30 on a lower portion of the frame 14 of the vehicle 10. The ring gear 13 is then moved upwardly into contact with the first load bearing strips 44 and the ring gear 13 is maintained in this contacting position. Lugs 50 of second load bearing strips 48 are inserted into respective vertical slots 28 of a plurality of shoes with the upper surface portion and the outer end 26 of the shoes covered by said strips 48.

The shoes are then moved upwardly toward the ring gear 13 and the upper surface of the second strips 48 are positioned in forcible contact with the ring gear 13. At this position, the shoes 24 are connected to the frame and the shoes 24 are moved outwardly to a holding position at which the outer end 26 of the second strips 48 are immediately adjacent the ring gear 13.

The shoes 24 are then fixed at this position to the frame and support the ring gear against movement in any direction other than rotationally about its axis by forcible contact of said ring gear 13 only by the first and second bearing strips 44, 48.

Where the shoe 24 is of a configuration as shown in FIG. 3, shims 52 can be positioned between the shoe 24 and the frame 14 for positioning said shoe a preselected distance from the frame.

The embodiments of the invention in which an exclusive property or privilege is claimed are defined as follows:

1. A work vehicle, comprising:

a draw bar frame having a plurality of recesses;

a work element;

a ring gear having first and second legs and being of a general "L" cross sectional configuration and fixedly connected to the work element;

a plurality of shoes each having an end having at least one slot extending generally vertically along the end in the installed position with the shoe movably connected to the frame and the first ring gear leg positioned between the shoe and an overlaying frame portion;

first means for selectively movably and fixedly connecting the shoe to the frame;

second means for controllably moving the shoe toward and from the ring gear;

a plurality of first bearing strips positioned between and in load bearing contact with the first leg of the ring gear and the overlaying frame portion, each of said first bearing strips having at least one portion of a construction sufficient for generally vertically insertion into a respective recess, generally vertical removal from said recess, and for maintaining said first bearing strip against generally horizontal movement relative to said frame in response to preselected forces subjected thereon by the ring gear, said first bearing strips being formed of organic plastic having fiberglass strands and being of a thickness sufficient for maintaining the ring gear spaced from the overlying frame; and a plurality of second bearing strips each being of a general "L" cross sectional configuration and positioned over an end portion of a respective shoe and between and in load carrying contact with said shoe and the first and second legs of the ring gear, each of said second bearing strips having at least one lug of a construction sufficient for insertion into a respective generally vertical shoe slot, removal from said slot, and for maintaining said second bearing strip against generally horizontal movement relative to said shoe in response to forces subjected thereon by the ring gear, said second bearing strip being formed of organic plastic having fiber glass strands and being of a size sufficient for maintaining the ring gear spaced from all portions of the shoe.

2. A work vehicle, as set forth in claim 1, wherein the first and second bearing strips each have fiberglass strands in a preselected amount sufficient for increasing the resistance of the strips to heat deflection and cold flow while maintaining substantially unchanged the abrasion and impact resistance properties of the organic plastic.

3. A work vehicle, as set forth in claim 1, wherein the bearing strips are of an elongated arcuate configuration as viewed from above in the installed position and has a generally planar contacting surface.

4. A work vehicle, as set forth in claim 1, wherein the recesses of the frame are formed by a hole extending into the frame.

5. A work vehicle, as set forth in claim 1, wherein the recesses of the frame are formed by elements connected to a surface of the frame.

6. A work vehicle, as set forth in claim 1, wherein the first means comprises a bolt of a preselected diameter extending through a shoe slot having a slot length greater than the bolt diameter as measured along the radius of the ring gear.

7. A work vehicle, as set forth in claim 1, wherein the second means comprises:

a threaded member connected to the frame and being controllably movable along a radius of ring gear and into forcible contact with a respective shoe.

* * * * *